United States Patent [19]

Morsing

[11] Patent Number: 4,496,253

[45] Date of Patent: Jan. 29, 1985

[54] IMPACT HAMMER

[75] Inventor: Gijsbertus B. Morsing, Heumen, Netherlands

[73] Assignee: Daisy Systems, Holland B.V., Netherlands

[21] Appl. No.: 486,696

[22] Filed: Apr. 20, 1983

[51] Int. Cl.[3] ..... B41J 9/38

[52] U.S. Cl. ..... 400/163.1; 400/167; 400/157.2; 400/686; 101/93.02

[58] Field of Search ..... 400/144.2, 157.2, 163.1, 400/167, 686, 687; 101/93.02, 93.48; 335/256, 257, 259

[56] References Cited

U.S. PATENT DOCUMENTS

| | | | |
|---|---|---|---|
| 3,675,172 | 7/1972 | Petusky | 400/686 X |
| 4,290,356 | 9/1981 | Hehl | 101/93.34 |
| 4,412,197 | 10/1983 | Bohg et al. | 101/93.48 |

FOREIGN PATENT DOCUMENTS

| | | | |
|---|---|---|---|
| 61588 | 4/1982 | Japan | 101/93.48 |

OTHER PUBLICATIONS

IBM Technical Disclosure Bulletin, "Horizontal Sliding Print Mechanism", by Patterson et al., vol. 25, No. 11B, Apr. 1983.

Xerox Disclosure Journal "Multi-Impact Backstop for Print Hammer", by Mitrovich, vol. 1, No. 4, Apr. 1976, p. 21.

IBM Technical Disclosure Bulletin, "Impact Printer Hammer Damping System" by Hall et al., vol. 22, No. 8B, Jan. 1980, p. 3498.

*Primary Examiner*—Paul T. Sewell
*Assistant Examiner*—John A. Weresh
*Attorney, Agent, or Firm*—Kane, Dalsimer Kane, Sullivan and Kurucz

[57] ABSTRACT

The inventor discloses a hammer assembly suited for use in generating impact for printers, such as printers using daisy-wheels. The assembly comprises an electromagnetic assembly for selectively producing an electromagnetic field across an air gap. A hammer element is slidably disposed in said gap so that it is biased in a rest position and moves toward another position when said field is activated.

A damping assembly is provided to dampen the reciprocating movement of the hammer element. The damping assembly has a rigid element which collides with the hammer element to bring it to a stop at its rest position. A shock absorbing element is used to dissipate the kinetic energy of the element.

4 Claims, 6 Drawing Figures

IMPACT HAMMER

BACKGROUND OF THE INVENTION

1. Field of Invention

The invention relates to hammer assemblies used in machines requiring high speed precision impacting of a desired object to struck, such as printers.

2. Description of the Prior Art

A high speed serial printer is known of the type employing a rotatable printwheel having a plurality of character elements extending radially from a central hub. In such so called "daisy-wheel printers", the printwheel is rotated until a character element desired for printing reaches a predetermined printing position. Then the hammer assembly is activated to cause the hammer-element to strike the character element causing the imprinting of the character element on a desired recording medium.

Presently most used hammer assemblies can be grouped into the following types:

a. Ballistic hammers: This is the most frequently used type for daisywheel printer applications. It uses a conventional electromagnetic actuating assembly with a hinging armature or sliding plunger. The armature or plunger is normally pushed or pulled into a rest position by a spring until the electromagnetic assembly is actuated, at which time the armature or plunger is forced forwardly. This forward movement results in a corresponding free flight forward movement of a separate hammer element. This hammer element will continue to "fly" forwardly until its front end, or tip, contacts the object to be struck (i.e. a character element). The hammer-element or "striker" reciprocating motion requires separate guiding means and a spring to bias the striker to its rest position.

The advantage of such ballistic hammber assembly is that the striker can have a long throw, limited only by its guiding (bearing) means.

A disadvantage is that it requires at least two moving parts and two springs. This results in a limited lifetime, considerable acoustical noise and critical mechanical adjustments and tolerances.

b. Impacting armature or plunger: In this type of device the free-flying striker piece of the above explained construction is omitted. The object to be struck (the character element in case of a daisywheel printer) is directly hit by the armature or plunger.

The advantage of such construction is its simplicity (low cost) and reliability. A major deficiency however is its limited throw, since the efficiency of the electromagnetic actuator drops considerably as the magnetic airgap is increased. If a hinging armature is used, the required throwlength can be obtained by extending the armlength. This however results in a bulky construction. Another disadvantage is that the operating frequency is limited by the bounce effects of the relatively heavy plunger or armature, as it returns to its rest position.

c. Voice coil hammer: These hammers do use a coil as part of a reciprocating hammer element, positioned in a permanent magnetic field. By forcing a current through the coil the hammer element will be driven forwardly to hit the object to be struck. The hammer element normally is retracted by a spring.

The advantage of such voice coil hammer is its low inertia hammer element and consequently high speed, allowing high-frequency operation. A severe disadvantage is its limited lifetime in printer applications. Furthermore, the impact shocks cause fatigue in the coil wire and coil connections which tend to break them.

OBJECTIVES OF THE INVENTION

An objective of this invention is to make use of all the advantages of a plunger-type impacting hammer without the above-mentioned disadvantages of the limited throw and limited operating frequency.

A further objective is to provide an impact hammer which is light weight, compact, simple to construct and assemble, relatively inexpensive and reliable.

Other objectives and advantages are described in the description of the invention below.

SUMMARY OF THE INVENTION

In accordance with this invention, instead of having a paramagnetic material pulled to the surface of an electromagnetic pole, the paramagnetic material is attracted to a position disposed between two poles so that the stroke of the hammer to which the paramagnetic material is secured, is not limited by the poles.

The bounce of the hammer is effectively reduced or eliminated by providing a shock absorber comprising an object having a mass equal to the mass of the hammer for absorbing the momentum of the hammer thus bringing the hammer to a stop and a damping element for damping the movement of the object.

DESCRIPTION OF THE PREFERRED EMBODIMENT

Reference is now made to the Figures wherein the same parts are identified by the same reference numbers in the various figures.

Figure 1:
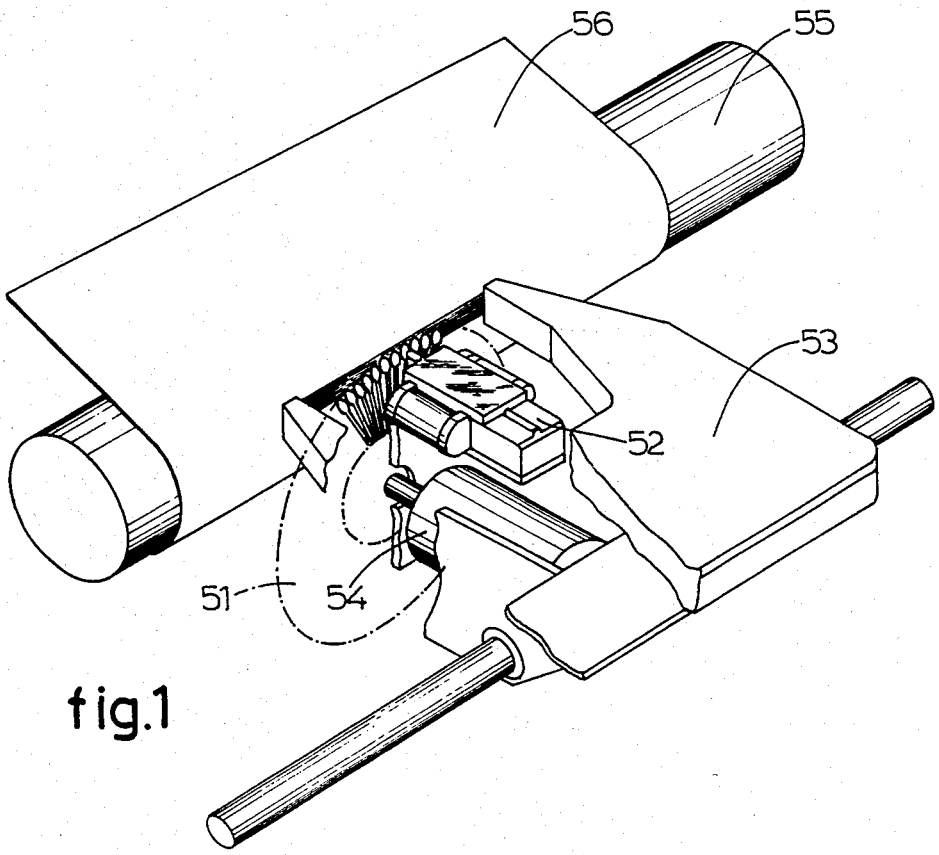
FIG. 1 is typical carriage assembly of a serial printer.

A typical carriage assembly for a serial printer, as shown in FIG. 1, comprises a "daisy-wheel" printwheel 51, a hammer assembly 52, and a ribbon cartridge 53 providing an inked ribbon 53.

The carriage assembly is adapted to transport a printwheel (51) mounted to the shaft of a motor (54), a hammer assembly (52) and a ribbon cartridge (53) along the axis of a cylindrical support plate (55). Once the carriage assembly is positioned by a motor/belt drive (not shown), the ribbon is advanced by another motor (not shown), and the printwheel is positioned by motor 54, the hammer will strike the selected character-element. This will result in the appearance of an imprint of the selected character on paper 56.

Figure 3:
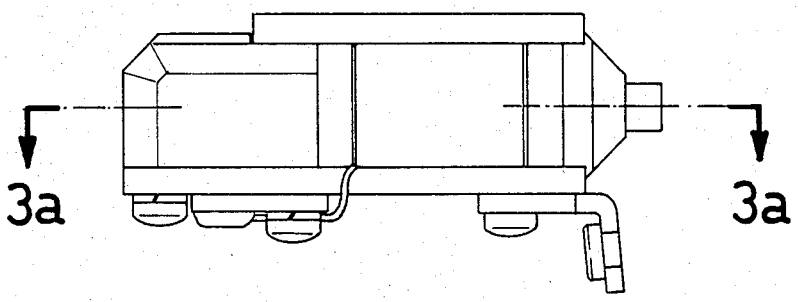
FIG. 3 is a side-view of the hammer assembly of FIG. 1.
Figure 2:
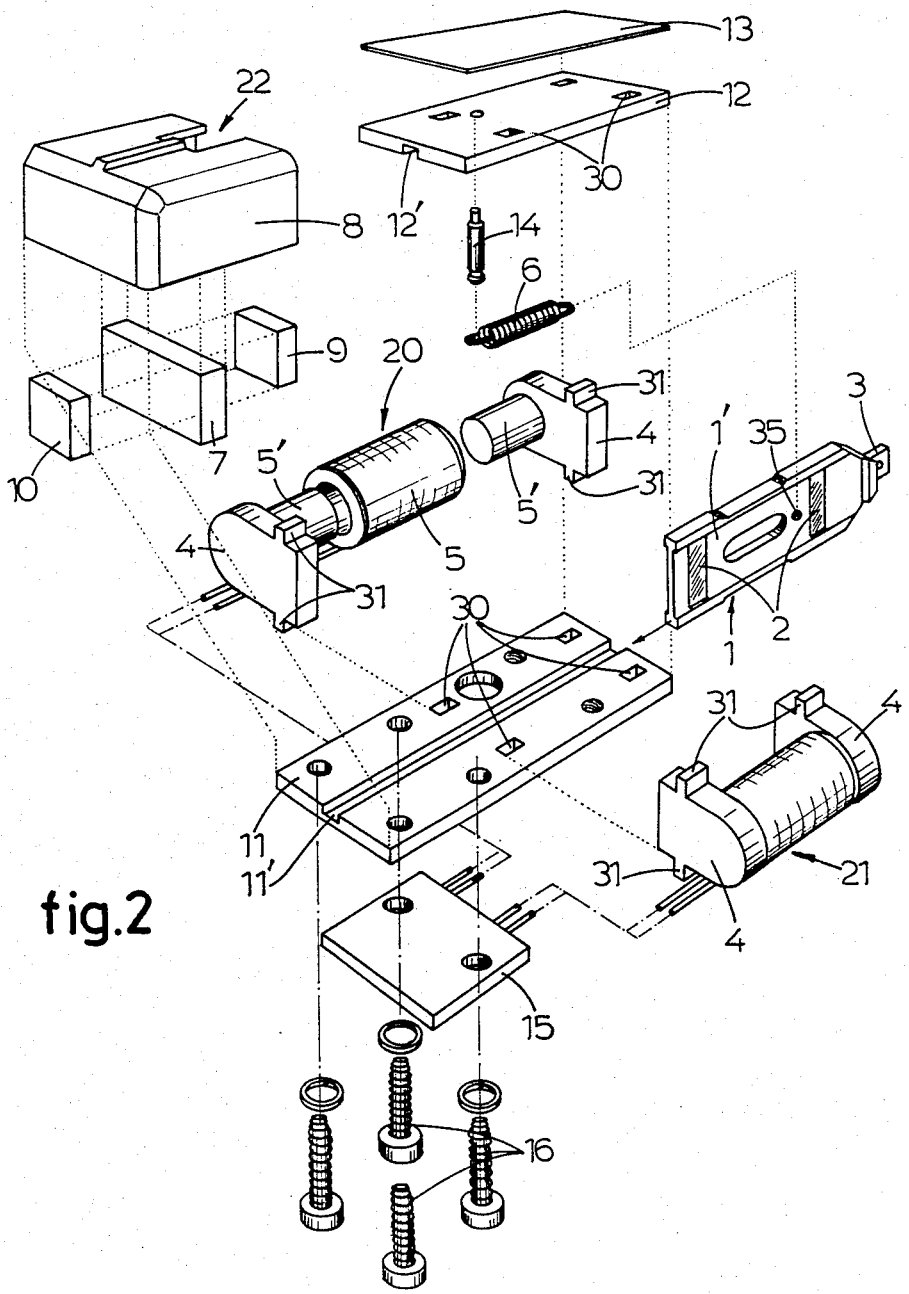
FIG. 2 is an exploded view of the hammer assembly of FIG. 1.
Figure 3A:
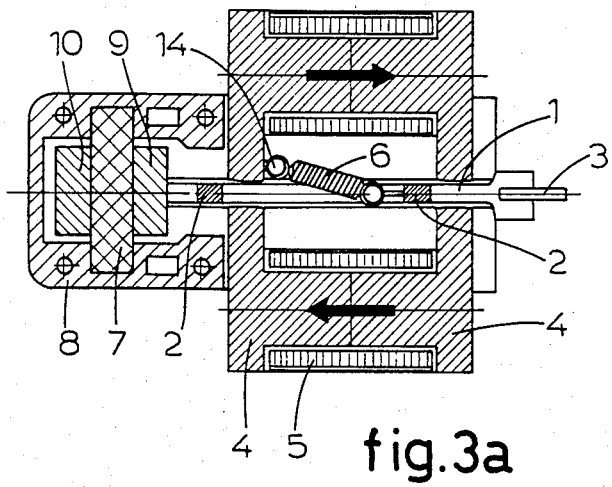
FIG. 3*a* is a cross-section view of the hammer assembly of FIG. 1.
Figure 4A:
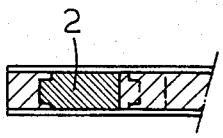
FIG. 4*a* is a partial cross-section view of the hammer element.
Figure 4:
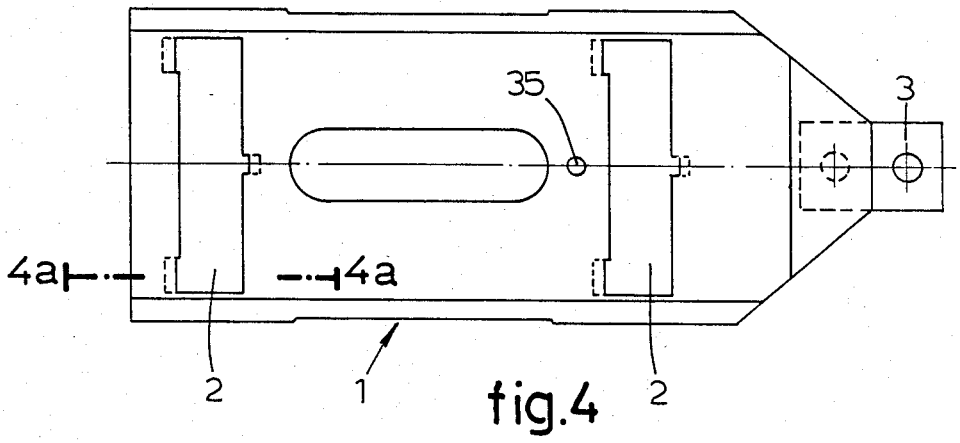
FIG. 4 is a side-view of the hammer element.

As shown in FIGS. 2–4, the hammer assembly comprises a hammer or "flyer" 1, two electromagnetic assemblies 20, 21 and a bumper assembly 22.

The hammer element 1 comprises a body 1' of a light and relatively strong synthetic material. This body may be manufactured by any known manner, such as molding. Affixed to the body is a hammer tip 3 of a relatively hard material. This is the portion of the hammer element which actually hits the print wheel. Two inserts 2 are rigidly secured to the body during the molding process. These inserts are made of a paramagnetic material such as soft iron. Since the hammer element is adapted to slide back and forth along its longitudinal axis, the body is preferably made out of self-lubricating nylon material. The top and the bottom edges of the body are shaped to minimize the frictional surface of the body.

Each of the electromagnetic assemblies comprises a coil 5 wound around an armature 5', and two sintered poles 4. The elements of the hammer assembly are held together by a lower and an upper mounting plate 11 and 12. Each of these plates has a groove 11' and 12' respectively through which the hammer element can slide as described in the previous paragraph while maintaining its substantially normal position with respect to the mounting plates. The mounting plates are also provided with square mounting holes 30 which mate with the square projections 31 provided on the sintered poles so that when the coils 5, poles 6 and the mounting plates 11 and 12 are assembled together the electromagnetic assemblies 20, 21 are held between the mounting plates. Preferably the square projections are riveted to the plates to insure a rigid and permanent assembly. The mounting plates are made of a light, rigid, non-magnetic material such as aluminum.

The coils 5 are connected in parallel but opposite directions so that when they are energized the electromagnetic assemblies form a substantially square path for the electromagnetic field as shown by the arrows of FIG. *3a*.

A stud 14 is secured substantially perpendicularly to uppermounting plate 12 to provide an anchor point to one end of spring 6. The other end of the spring is secured by a spring hook to the hammer element 1 through a hole 35. The spring is provided to bias the hammer element to its rest position shown in FIG. *3a*. It can be seen from this FIG. 3 that two air gaps are formed between the two electromagnetic assemblies to accommodate the hammer element. Furthermore, as seen in said FIG. *3a*, when the hammer element is in its rest position the inserts 2 are adjacent to and to the left of the air gaps. When the electromagnetic assemblies are activated, the paramagnetic inserts move into the gaps causing the hammer element 1 to move to the right.

The bumper assembly 22 comprises a damper element 7 and a rigid plate 9 which damper element 7 and rigid piece 9 are mounted in a housing 8 secured to the lower mounting plate 11 by screws 16. Damper element 7 is made of a soft shock absorbing element such as rubber adapted to absorb and dampen energy through deformation. The rigid piece 9 is made of a relatively heavy, non-magnetic material such as brass and is positioned so that when the hammer assembly is completed it just touches the left end of hammer element 1. The mass of the piece is equal to the mass of the hammer element.

The hammer assembly functions as follows. When the electromagnetic assemblies are not activated the hammer element is in rest position illustrated in FIG. *3a*. In order to cause the hammer elements, i.e. the hammer tip 3 to strike the printing wheel, the electromagnetic assembly is activated by providing an electric signal thereto from printed circuit board 15. The speed of the hammer element may be varied at will by adjusting the amplitude and/or duration of the signal. This impact modulator is desirable because not all the letters of the printing wheel require the same force to produce a uniform imprint. For example, it is known that the letters "Q" and "i" need different striking forces.

The activation signals to the circuit board 15 are provided by a microprocessor (not shown) which also controls all the other functions of the printer in a well known manner, such as carriage control, wheel positioning, ribbon transport and paper advancement.

After it delivers the required impact the hammer element is returned to its rest position by the spring. However the spring and the hammer element form an oscillatory system which tends towards a reciprocating motion of the element. Since intentionally the frictional forces on the element are minimized the damping on the oscillatory system is correspondingly small so that normally it would take a relatively long time until the oscillatory systems comes to its rest position.

This problem is solved by the bumper assembly. As the hammer element reaches its rest position on its way back a semi-elastic collision occurs between it and piece 9. Since piece 9 has the same mass as the hammer element all the momentum and kinetic energy of the hammer element is transferred to piece 9 and the hammer element comes to a stop. The kinetic energy of rigid piece 9 is in turn absorbed by the damper element 7 which is held rigidly by housing 8.

The inventor has found that the performance of the bumper assembly is improved if a second piece 10, substantially identical to piece 9 is secured to damping element 7 on the side opposite to piece 9. This second piece is allowed to move with respect to housing 8 and it assists in the dissipation of the kinetic energy.

The spring 6, which preferably is helical, and is provided to return the hammer element to its rest position, may be supplemented by or even replaced with a permanent magnet suitably secured to the mounting plate to attract the paramagnetic inserts. Furthermore, the arrangement herein may be modified so that two or more hammer elements could be secured on the same mounting plates, said hammer elements being adapted to operate independently while sharing parts.

The present invention was described herein above, in relation to a printer. However clearly it could be used in other devices requiring fast and reliable impact actions.

Other modifications may be made without departing from the scope of the invention as defined in the appended claims.

What is claimed is:

1. An electromagnetic hammer assembly comprising:

a hammer element having a hammer tip;

control means for guiding said hammer element in reciprocating movement between a rest position and a striking position;

means for selectively producing an electric field for urging the hammer element from said rest position toward said striking position;

a return spring for biasing said hammer element toward said rest position; and a bumper assembly delimitting said rest position and adapted to debounce said hammer element as it is returned from said striking to said rest position, said bumper assembly comprising a housing, a stationary shock absorbing element affixed to said housing and two rigid pieces, each having a weight equal to the hammer element weight, said rigid pieces being positioned on two opposed sides of said shock absorbing element and movable with respect to said housing and each other to absorb the kinetic energy of said hammer element after each collision between said hammer element and one of said rigid pieces.

2. The hammer assembly of claim 1 wherein said hammer element comprises a non-magnetic body and paramagnetic member inserted therein.

3. The hammer assembly of claim 2 wherein said control means comprises two stationary electromagnetic poles defining therebetween an air gap, said poles being positioned and arranged to selectively attract said paramagnetic member toward said air-gap without interfering with the reciprocal movement of said hammer element.

4. The hammer assembly of claim 1 wherein said shock absorbing element is made of a material adapted to absorb the kinetic energy of said hammer element by deformation.

* * * * *